US005472319A

United States Patent [19]

Rohlfing et al.

[11] Patent Number: 5,472,319

[45] Date of Patent: Dec. 5, 1995

[54] ECCENTRIC SCREW PUMP WITH LIQUID BYPASS CONTROLLED BY A FLEXIBLE DIAPHRAGM

[75] Inventors: Gerhard Rohlfing, Hille; Jens-Uwe Brandt, Rinteln, both of Germany

[73] Assignee: Joh. Heinrich Bornemann GmbH & Co. KG, Obernkirchen, Germany

[21] Appl. No.: 301,567

[22] Filed: Sep. 7, 1994

[30] Foreign Application Priority Data

Sep. 7, 1993 [DE] Germany ..... 43 30 226.2

[51] Int. Cl.[6] ..... F04B 49/00; F01C 5/00

[52] U.S. Cl. ..... 417/307; 417/310; 418/48

[58] Field of Search ..... 418/48, 153; 417/310, 417/307

[56] References Cited

U.S. PATENT DOCUMENTS

| | | | |
|---|---|---|---|
| 2,413,040 | 12/1946 | Elliot | 417/310 |
| 2,472,734 | 6/1949 | Thomas et al. | 417/310 |
| 2,826,152 | 3/1958 | Michie | 418/48 |
| 3,380,391 | 4/1968 | John | 418/48 |
| 3,813,187 | 5/1974 | Winter | 417/310 |
| 4,284,212 | 8/1981 | Caswell | 251/30 |
| 4,307,889 | 12/1981 | Piazza | 417/310 |
| 4,401,417 | 8/1983 | Davis | 417/310 |
| 4,714,413 | 12/1987 | Duffy | 417/310 |
| 5,108,273 | 4/1992 | Romanyszyn, Jr. | 418/48 |

FOREIGN PATENT DOCUMENTS

| | | | |
|---|---|---|---|
| 1957172 | 3/1967 | Germany . | |
| 1965063 | 9/1967 | Germany . | |
| 7104996.2 | 2/1971 | Germany . | |
| 2925830 | 1/1981 | Germany . | |
| 3818508 | 12/1989 | Germany | 418/48 |

*Primary Examiner*—Richard A. Bertsch
*Assistant Examiner*—Ted Kim
*Attorney, Agent, or Firm*—Foley & Lardner

[57] ABSTRACT

An eccentric screw pump with a pump casing (1) having an intake stub (6) and a delivery stub (7) and enclosing a suction chamber (8) and a delivery chamber (9). A stator (2) arranged in the said casing surrounds a rotor (3) that can be driven by a motor. In order to permit multi-phase delivery, a lower portion (9*a*) of the delivery chamber (9) is connected to the suction chamber (8) via a liquid bypass line having a valve opening (13) that can be actuated by a control element on the basis of the differential pressure between the delivery and the suction chambers (9, 8) in such a way that the valve (13, 14) is open in the case of the differential pressure which arises in the delivery of dry-running gas but is closed in the case of the differential pressure which arises during the delivery of liquid.

20 Claims, 2 Drawing Sheets

ECCENTRIC SCREW PUMP WITH LIQUID BYPASS CONTROLLED BY A FLEXIBLE DIAPHRAGM

BACKGROUND OF THE INVENTION

1. Field of the Invention

The invention relates to an eccentric screw pump with a pump casing having an intake stub and a delivery stub and enclosing a suction and a delivery chamber. The pump has delivery elements adapted to be driven by a motor in the form of a casing insert and an eccentric screw arranged in the pump casing.

2. Description of the Related Art

The method of delivery of conventional eccentric screw pumps makes them suitable to convey a gas with the liquid. However, in the case of high gas rates in the liquid or dry running of gas, the friction heat engendered between the delivery elements can no longer be dissipated. The term dry running of gas is intended to mean the condition when no liquid is in the gas, and will be referred to hereinafter as to the state when only gas is being delivered by the pump. This undissipated heat results in the stator formed of elastomer being thermally destroyed after a few seconds of operation.

In the case of overloading by excess pressure caused, for example, by a blockage of the delivery line, conventional eccentric screw pumps continue to build up pressure until the elastomer of the delivery unit lifts off from the sealing line and the pumping medium flows back within the delivery unit. During this process, the power consumption of the pump rises proportionally to the differential pressure between the delivery chamber and the suction chamber.

In the case of an overdimensioned driving motor, when an excess pressure occurs the pump continues to turn but the frictional heat engendered can no longer be dissipated by the stationary pumping medium. This also results in the elastomeric stator being thermally destroyed within a short time. Alternatively, if the driving motor is adequately dimensioned for the operating conditions, the pump is brought to a halt in the event of overloading by excess pressure. This can lead to destruction of the electric motor used to drive the pump.

SUMMARY OF THE INVENTION one object of the invention is to provide an eccentric screw pump having improved characteristics that do not result in damage or destruction of the pump or related driving motor when certain operating conditions are encountered.

This object and other objects readily apparent to those skilled in the art are achieved, according to the invention, by providing an eccentric screw pump with a lower portion of the delivery chamber connected to the suction chamber via a liquid bypass line with a valve that can be actuated by a control element on the basis of the differential pressure between the delivery and the suction chambers. The valve is open when the differential pressure arises in the event of only gas being delivered by the pump. The valve is closed when the differential pressure arises during the delivery of liquid.

Another objective of this invention is to provide a lower portion of the delivery chamber that stores a proportion of the liquid pumping medium and uses the liquid for circulation within the pump when the gas rates in the pumping medium increase. For this purpose, the invention provides a valve which connects the delivery chamber to the suction chamber. These chambers are divided off in pressure-tight fashion from each other. A valve that is controlled automatically as a function of the differential pressure between the delivery chamber and the suction chamber operates to open and close as a function of the particular operating conditions within the pump.

As the gas rates increase in the pumping medium, as for example with foam delivery, the valve is opened to allow the quantity of liquid stored in the lower portion of the delivery chamber to flow back through the opened valve into the suction chamber. This direction is counter to the actual direction of delivery. From the suction chamber it is pumped back into the delivery chamber. This recirculated quantity of liquid is used to dissipate the heat engendered by the friction between the rotor and the stator of the pump. This recirculation of liquid prevents overheating to avoid destruction of the elastomer stator in the eccentric screw pump.

Another objective is to create an eccentric screw pump suitable for multi-phase delivery.

Another objective is to provide the pump with a control element that adjusts a valve to a maximum opening position when subjected to a high differential pressure resulting from overloading by excess pressure. This overload safeguard provides for liquid to flow from the delivery chamber to the suction chamber and allows the pumping medium to be recirculated within the pump when the overload condition is obtained. This feature creates a pump that avoids damage or destruction of the electric drive that drives the pump motor and prevents destruction of the elastomer stator from overheating.

According to another objective of this invention, a pressure-tight dividing wall is provided between the suction chamber and the delivery chamber in the form of a flexible diaphragm which is firmly connected to the stator. The diaphragm and the stator preferably form a one-piece elastomer component.

Another objective is to have the diaphragm serve as both the pressure tight dividing wall and the control element for the valve. In a particularly simple embodiment, the diaphragm has, in its lower diaphragm segment that separates the lower portion of the delivery chamber from the suction chamber, a valve opening which is axially displaceable together with the diaphragm segment relative to a valve-closing element that passes through it. The valve-closing element can be arranged in a fixed manner and has a control cross section that varies in the axial direction. The type of control involved is of the orifice type, and the control cross section of the valve-closing element tapers in the two opposite axial directions from a maximum diameter completely closing the valve opening. This tapering of the cross section can be conical such that when the valve opening is displaced axially, its dross sectional flow increases continuously or, in the case of axial displacement in the opposite direction, narrows continuously.

Another objective is to provide a stator suspended solely from a diaphragm such that it provides the resilient support for the stator and can take up radial relative movements of the stator. This avoids the conventional use of universal joints between the motor shaft and the eccentric screw (rotor).

Another objective of the invention is to dimension the valve cross section of the liquid bypass line such that, during driving delivery of pure gas by the unit, a volume of liquid of about 15% of the pump delivery volume is allowed to recirculate.

Another objective is to prevent objects that may damage the pump, such as pins, needles, bolts or welding electrodes, from entering the delivery chamber together with the pumping medium. Thus, a labyrinth guide is preferably arranged downstream of the intake stub to catch these contaminants.

Another objective of the invention is to provide an eccentric screw pump suitable for multi-phase delivery that can be used in washing machines for pumping away or emptying the washing water or suds. In contrast to the centrifugal pumps used in washing machines, with the eccentric screw pump according to the present invention, it is possible to draw foam out of the washing machine. Thus, the laundry is thus left largely foam-free after pumping off and conclusion of the main washing cycle. This results in fewer residues of detergent remaining in the laundry and allows a considerable reduction in the consumption of water in the rinsing cycle.

Further features of the invention are explained in greater detail with reference to an exemplary embodiment in conjunction with further advantages of the invention.

BRIEF DESCRIPTION OF THE DRAWINGS

The drawings illustrate an exemplary embodiment of the invention. In the drawings.

DETAILED DESCRIPTION OF THE PREFERRED EMBODIMENTS

Figure 1:
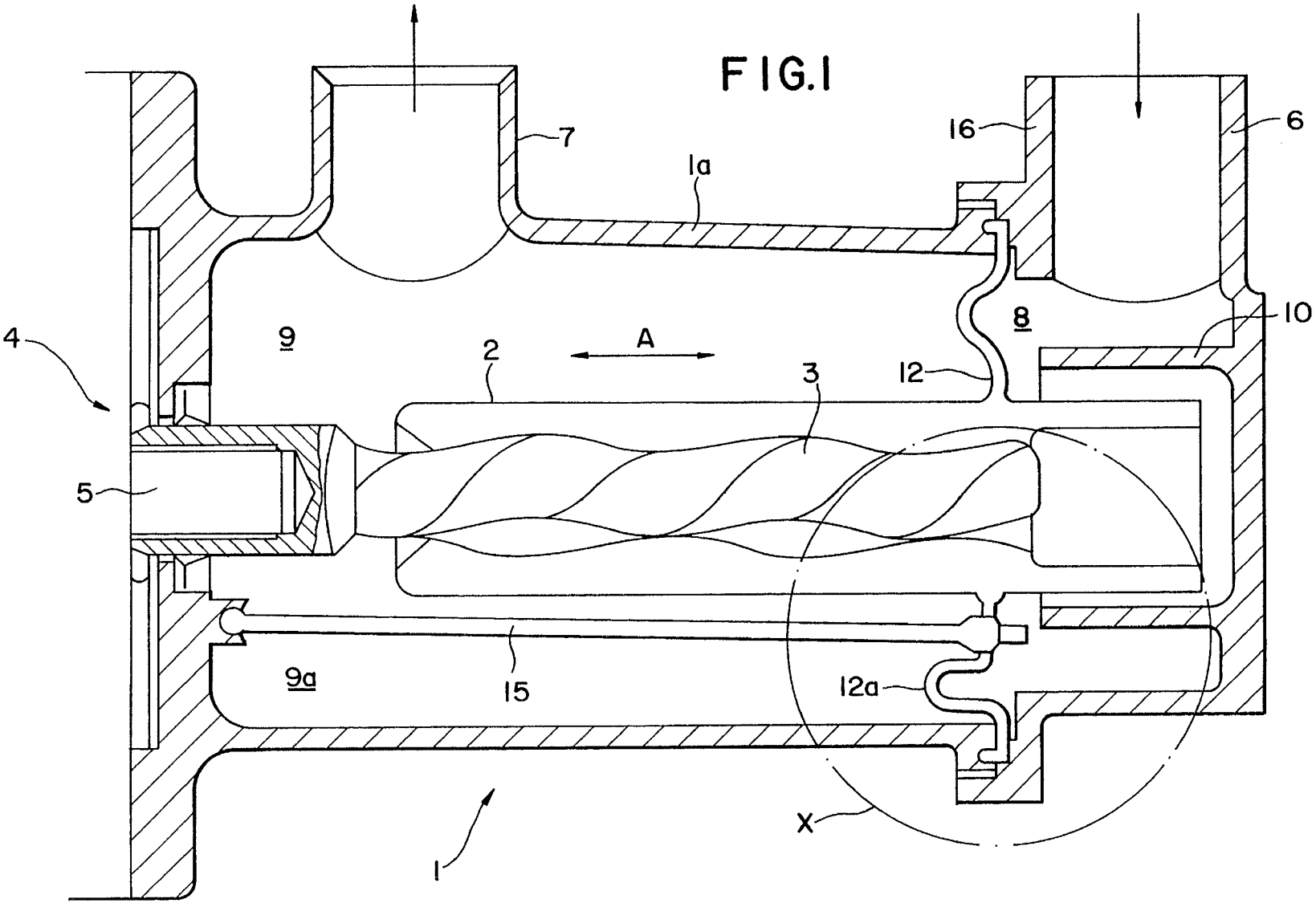
FIG. 1 is a longitudinal section of an eccentric screw pump in an operating liquid delivery state according to the present invention.

The eccentric screw pump shown in FIG. 1 comprises a pump casing 1, a casing insert 2 (stator) arranged therein, and an eccentric screw 3 (rotor) surrounded by the stator 2 and drivable by a motor (not shown). For connection to the motor shaft (not shown), the rotor 3 has a plug-in coupling 5 on the driving side 4 of the pump.

The upper side of pump casing 1 is provided with an intake stub 6 and a delivery stub 7, each arranged vertically. The pump casing 1 surrounds a suction chamber 8 arranged downstream of the intake stub 6 and a delivery chamber 9 arranged upstream of the delivery stub 7. The latter chamber has a lower portion **9*a* lying below the stator 2. Arranged directly downstream of the intake stub 6 is a labyrinth guide 10 having an upper side facing the intake stub 6** for relatively large contaminants in the pumping medium to settle. An example of these contaminants are pins carried along in washing water that is running through the pump.

The direction of delivery in the pump casing 1 is towards the driving side 4.

The pump casing 1, which is preferably composed of plastic, is made up of two casing parts **1*a*, 1*b*. Between the two casing parts is formed a joint 11 lying transverse to the axial direction of the pump casing. The joint 11 clamps the circumference of a diaphragm 12 to form the seal between the two casing parts 1*a*, 1*b***.

Figure 2:
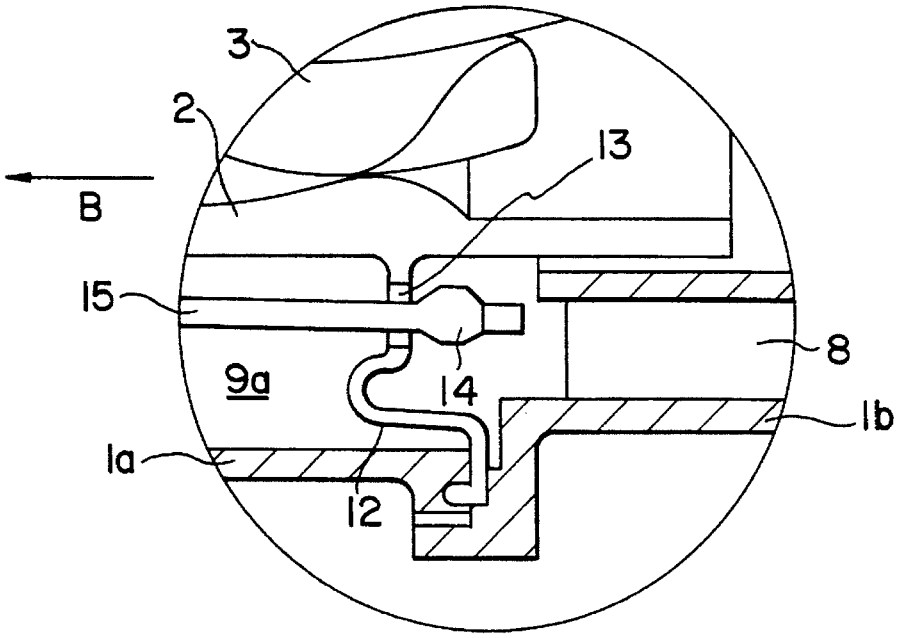
FIG. 2 is an enlarged section showing the detail of the section shown from the circle X in FIG. 1 when the pump is in dry-running gas delivery operating state.
Figure 3:
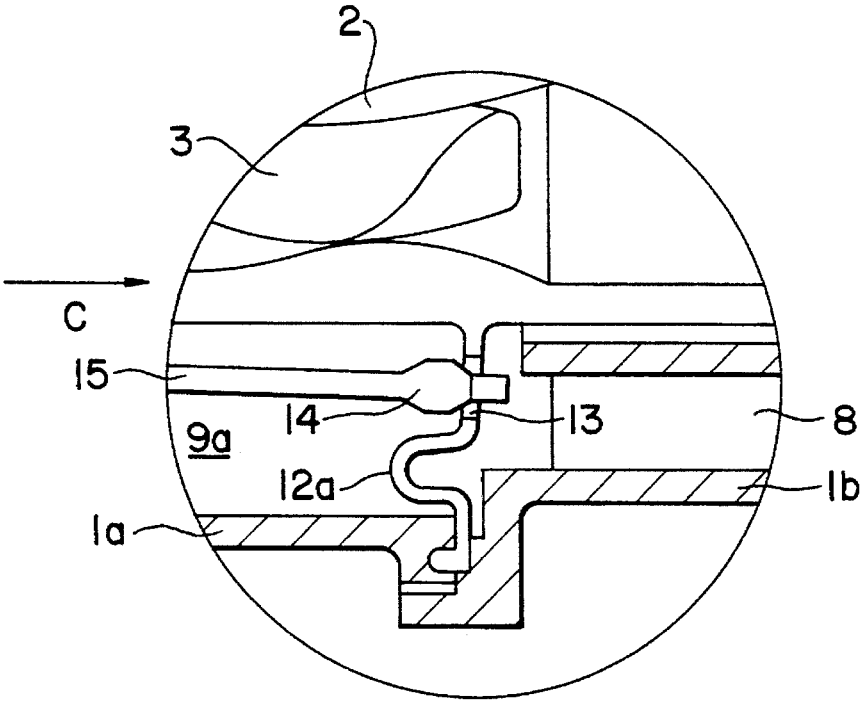
FIG. 3 is an enlarged section showing the detail of the shown from the circle X in FIG. 1 when pump is in an overload-safeguard operating state.

The diaphragm 12, which is of flexible design and is preferably composed of an elastomer, is molded onto the stator 2, which is also preferably composed of an elastomer. The stator 2 and diaphragm 12 are movable in the two directions shown by the double headed arrow A in FIG. 1. The diaphragm has an axially projecting annular fold **12*a*. In the diaphragm segment that separates the lower portion 9*a* of the delivery chamber 9 from the suction chamber 8, as shown in FIGS. 2 and 3, a valve opening 13 is formed. A free end of a rod 15 projects through the valve opening 13. The rod is equipped with a valve-closing element 14 on one end and fixed by its opposite end in the pump casing 1. This valve-closing element 14 has a central portion whose outside diameter corresponds approximately to the diameter of the valve opening 13 and tapers in the two opposite axial directions to the diameter of the rod 15**.

During operation as shown in FIG. 2, when the diaphragm 12 moves in the direction of arrow B, it occupies the rest operating state. In this position the diaphragm segment provided with the valve opening 13 is situated to the left, as shown in FIG. 2, of the valve-closing element 14 and remains adjacent to it. This opens the valve opening 13 and forms a liquid bypass line between the delivery chamber 9 and the suction chamber 8.

This position of the diaphragm 12 corresponds to the dry-running gas operating state or to gas/liquid delivery with a high proportion of gas. During gas/liquid delivery, a smaller differential pressure arises between the delivery chamber and the suction chamber as compared with the case of pure liquid delivery. This differential depends on the delivery-side pipe characteristics. The use of the term gas/liquid delivery is taken to include delivery of foam.

In order to prevent destruction of the stator 2 in the operating state shown in FIG. 2, when high liquid/gas rates or only gas is being pumped, a partial volume flow of liquid is separated off on the delivery side and guided back through the valve opening 13 and into the suction chamber 8 to be kept in circulation.

The lower portion **9*a* of the delivery chamber 9 is provided to ensure that a sufficient quantity of recirculating liquid remains for reliable functioning in the pump. The valve opening 13 has a cross section forming the liquid bypass line. The valve opening 13** is dimensioned so that during delivery of pure gas by the unit a volume of liquid of about 15% of the pump delivery volume is allowed to recirculate. The quantity of liquid kept in circulation serves to remove the heat engendered in the delivery elements and for the sealing gap.

As the gas rate falls, the differential pressure between the delivery chamber and the suction chamber increases. This causes the diaphragm 12 with the stator 2 to be displaced in the axial direction from the position shown in FIG. 2 to the right as shown by the arrow A in FIG. 1, until the diaphragm 12 and its valve opening 13 occupies the position shown in FIG. 1. This causes the valve opening 13 to be completely closed by the valve-closing element 14. In this position, the leakage flow is minimized, and efficiency of the pump is thus maximized. The axial displacement mentioned results from the spring characteristic of the diaphragm 12. Alternatively, an additional spring can be provided to assist the axial displacement of the stator 2 and diaphragm 12.

In the event of overload of excess pressure caused, for example, by a blockage of the delivery line, the differential pressure increases between the delivery chamber and the suction chamber. To provide for an overload release, the diaphragm 12 with the valve opening 13 in the position as shown in FIG. 1 is displaced further to the right, as shown by arrow C, relative to the valve-closing element 14 and then occupies the position shown in FIG. 3. The valve opening 13 is thus open again and in this operating state creates a flow from the delivery chamber 9 to the suction chamber 8 to allow the pumping medium to circulate within the pump.

What is claimed is:

1. An eccentric screw pump for delivery of gas and/or liquid, comprising:

a pump casing having an intake inlet and a delivery outlet and forming a suction chamber and delivery chamber;

delivery elements disposed within said pump casing adapted to be driven by a motor, including a casing insert forming a stator and an eccentric screw rotatable within said stator;

a liquid bypass line connecting said suction chamber and delivery chamber;

a valve provided in said liquid bypass line; and a control element for opening and closing said valve, said control element being a flexible diaphragm which is actuated on the basis of a pressure differential between said suction chamber and delivery chamber, such that during delivery of at least a predetermined proportion of gas said valve is set in an open position and during delivery of liquid said valve is set in a closed position.

2. The eccentric screw pump as claimed in claim 1, wherein said flexible diaphragm comprises a pressure-tight dividing wall between said suction chamber and said delivery chamber except for said valve provided in said liquid bypass line.

3. The eccentric screw pump as claimed in claim 2, wherein said flexible diaphragm is firmly connected to said casing insert; and wherein said diaphragm compensates all radial relative movements of said casing insert.

4. The eccentric screw pump as claimed in claim 3, wherein said diaphragm and said casing insert comprise a one-piece elastomer component.

5. The eccentric screw pump as claimed in claim 1, wherein said flexible diaphragm adjusts said valve to a maximum opening position, different than said open position, when subjected to a differential pressure resulting from overloading by excess pressure.

6. The eccentric screw pump as claimed in claim 5, wherein said flexible diaphragm comprises a pressure-tight dividing wall between said suction chamber and said delivery chamber, said flexible diaphragm being pressure-tight except for said valve provided in said liquid bypass line.

7. The eccentric screw pump as claimed in claim 6, wherein said flexible diaphragm is firmly connected to said casing insert; and wherein said diaphragm is movable along with said casing insert.

8. The eccentric screw pump as claimed in claim 7, wherein said diaphragm and said casing insert comprise a one-piece elastomer component.

9. The eccentric screw pump as claimed in claim 7, wherein the pump casing has two parts adapted for clamping said diaphragm between said two casing parts; and wherein said clamped diaphragm forms a sealing joint lying transverse to an axial direction of said pump casing.

10. The eccentric screw pump as claimed in claim 7, wherein said diaphragm is clamped in said pump casing at a circumference thereof and permits an axial displacement of an inner annular area of the diaphragm that is connected to the casing insert; and wherein the casing insert is suspended in said pump casing only by said diaphragm.

11. The eccentric screw pump as claimed in claim 10, wherein said diaphragm has an axially projecting annular fold.

12. The eccentric screw pump as claimed in claim 10, wherein said liquid bypass line is formed by a valve opening in said diaphragm segment that separates a lower portion of said delivery chamber from said suction chamber; wherein said valve opening is axially displaceable relative to a valve-closing element to form said valve; wherein the valve-closing element is configured to pass through said valve-opening by a control cross section that varies in an axial direction; and wherein the valve-closing element is arranged in a fixed manner in said pump casing.

13. The eccentric screw pump as claimed in claim 12, wherein said control cross section of the valve-closing element tapers in two opposite axial directions from a maximum diameter which is adapted for completely closing the valve opening.

14. The eccentric screw pump as claimed in claim 13, wherein said valve-closing element is seated on one end of a rod which is fixed in the pump casing by its other end.

15. The eccentric screw pump as claimed in claim 12, wherein said valve opening cross section is dimensioned such that when only gas is delivered by the screw pump a volume of liquid of about 15% of the pump delivery volume is allowed to recirculate.

16. The eccentric screw pump as claimed in claim 1, wherein said delivery outlet is arranged vertically in an upper side of said pump casing.

17. The eccentric screw pump as claimed in claim 1, further comprising a labyrinth guide arranged downstream of said intake inlet.

18. The eccentric screw pump as claimed in claim 1, wherein said pump casing is made of plastic.

19. The eccentric screw pump as claimed in claim 1, wherein said casing insert is a stator made of plastic.

20. An eccentric screw pump, for delivery of gas of liquid comprising:

a pump casing having a suction chamber and a delivery chamber;

a stator and an eccentric screw cooperating with said stator inside said pump casing;

a flexible diaphragm having a liquid bypass line which by movement of said flexible diaphragm selectively allows liquid to pass between said suction chamber and said delivery chamber for recirculation of liquid in said pump casing based on a pressure differential between said suction chamber and said delivery chamber to prevent damage to the screw pump components or to a motor adapted to drive said eccentric screw; and a valve provided in said liquid bypass line, wherein during delivery of at least a predetermined proportion of gas said valve is set in an open position and during delivery of liquid said valve is set in a closed position.

* * * * *